US006892960B2

(12) United States Patent
Ptak et al.

(10) Patent No.: US 6,892,960 B2
(45) Date of Patent: May 17, 2005

(54) AIRBRUSH

(75) Inventors: Victor Alfred Ptak, Plymouth, MI (US); John E. Nemazi, Bloomfield Hills, MI (US)

(73) Assignee: Advance Watch Company, Ltd., Warren, MI (US)

( * ) Notice: Subject to any disclaimer, the term of this patent is extended or adjusted under 35 U.S.C. 154(b) by 56 days.

(21) Appl. No.: 10/271,898

(22) Filed: Oct. 15, 2002

(65) Prior Publication Data

US 2004/0069869 A1 Apr. 15, 2004

(51) Int. Cl.[7] ..... A62C 31/00; B05B 7/06; B05B 7/12

(52) U.S. Cl. ..... 239/398; 239/424; 239/433; 239/409; 239/354; 239/346

(58) Field of Search ..... 239/398, 424, 239/433, 409, 351, 354, 361, 366, 368, 369, 344, 310, 311, 346, 43, 44

(56) References Cited

U.S. PATENT DOCUMENTS

| | | | | |
|---|---|---|---|---|
| 2,604,361 A | | 7/1952 | Yates | |
| 2,917,244 A | | 12/1959 | Gould | |
| D242,707 S | | 12/1976 | Phillips | |
| 4,020,990 A | | 5/1977 | Luff | |
| D247,506 S | | 3/1978 | Bass | |
| 4,247,339 A | | 1/1981 | Bolton et al. | |
| 5,088,903 A | | 2/1992 | Tomatsu | |
| 5,131,598 A | | 7/1992 | Hoogeveen, Jr. | |
| 5,156,684 A | | 10/1992 | Mayer et al. | |
| 5,158,804 A | | 10/1992 | Alkan et al. | |
| 5,190,220 A | | 3/1993 | Bolton | |
| 5,248,096 A | * | 9/1993 | Hoey et al. | 239/272 |
| 5,305,494 A | | 4/1994 | Candler | |
| 5,322,220 A | | 6/1994 | Rehkemper | |
| 5,366,158 A | | 11/1994 | Robisch et al. | |
| 5,421,518 A | | 6/1995 | Robisch et al. | |
| 5,687,886 A | | 11/1997 | Bolton | |
| 5,716,007 A | | 2/1998 | Nottingham et al. | |
| 5,779,157 A | | 7/1998 | Robisch et al. | |
| 5,832,974 A | | 11/1998 | Jou | |
| 5,842,646 A | | 12/1998 | Kitajima | |
| 5,927,602 A | | 7/1999 | Robisch et al. | |
| 5,961,050 A | | 10/1999 | Kitajima | |
| 5,988,527 A | | 11/1999 | Alosi | |
| 6,024,300 A | | 2/2000 | Bolton | |
| 6,270,021 B1 | | 8/2001 | Bolton | |
| 6,283,388 B1 | | 9/2001 | Bolton | |
| 6,306,221 B1 | * | 10/2001 | Magliocca | 134/10 |

FOREIGN PATENT DOCUMENTS

| | | | |
|---|---|---|---|
| EP | 0 092 359 A2 | 10/1983 | |
| GB | 2 257 058 | 1/1993 | |
| JP | 11047644 A * | 2/1999 | B05B/7/08 |

* cited by examiner

*Primary Examiner*—Davis Hwu
(74) *Attorney, Agent, or Firm*—Brooks Kushman P.C.

(57) ABSTRACT

The present invention discloses an airbrush including an elongate body having an internal cavity and an external grip surface to be held in the hand of a user. A DC electric motor and an air pump driven by the motor are oriented within the body cavity. A switch is oriented on the elongate body external surface proximate to a finger of a user's hand. A removable pen having an internal liquid reservoir and a nib cooperates with the elongate body and extends within an air chamber having an outlet nozzle and an inlet coupled to the air pump. The user selectively actuates a switch to cause the motor to drive the pump providing an air stream of pressurized air to the air chamber which flows above the nib drawing liquid particles therefrom, into the air stream forming a mist which is sprayed from an outlet orifice of the outlet nozzle.

38 Claims, 4 Drawing Sheets

Fig. 1
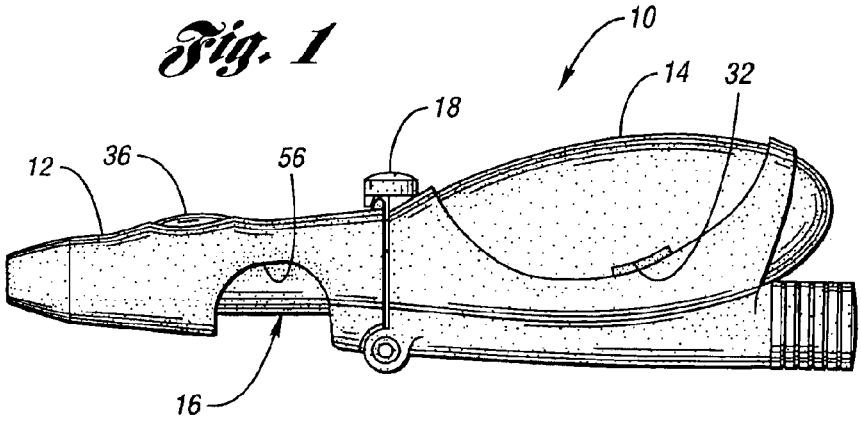
Fig. 2
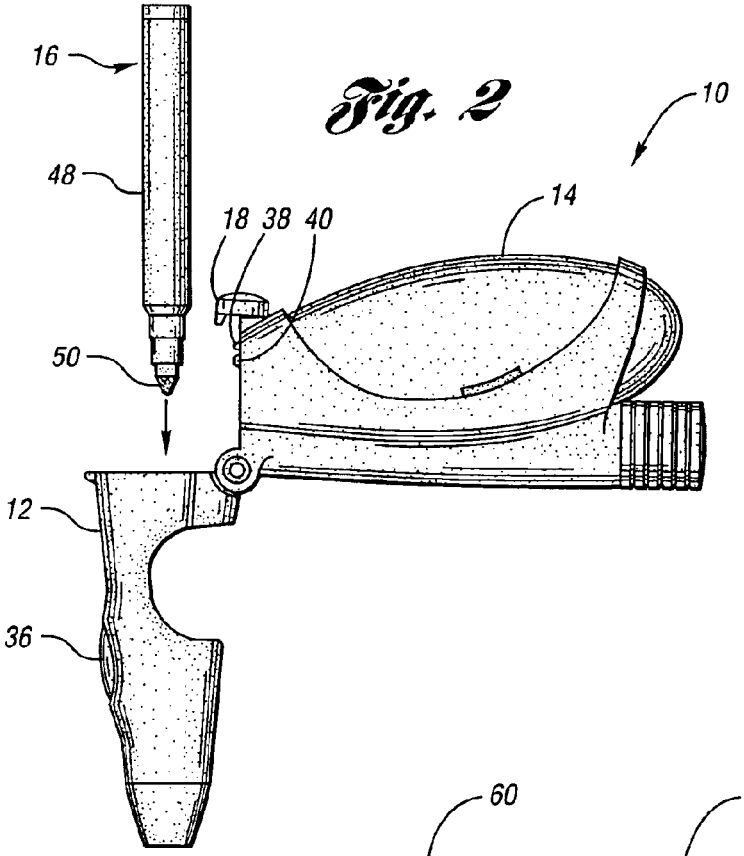
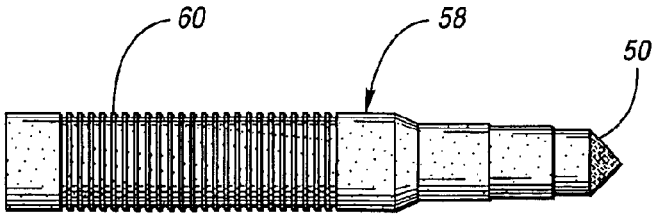
Fig. 3

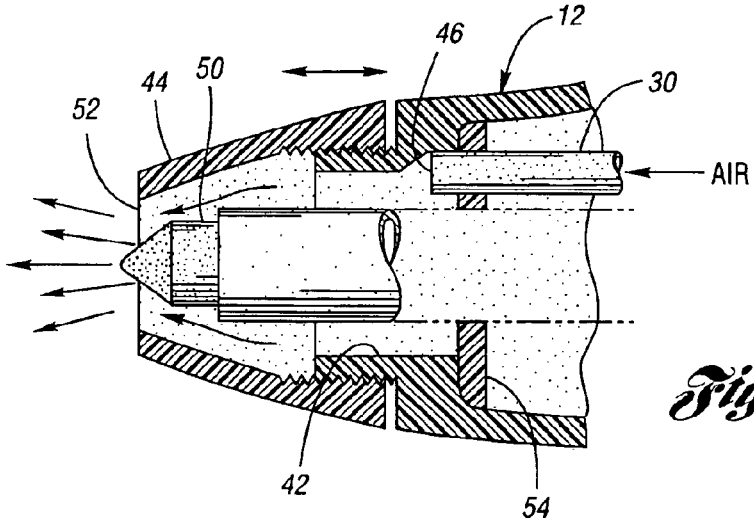
Fig. 4
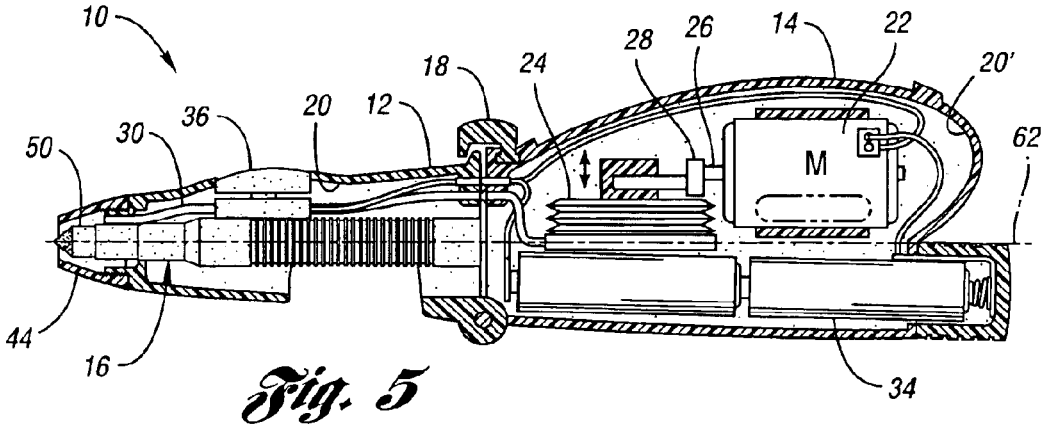
Fig. 5
Fig. 5a
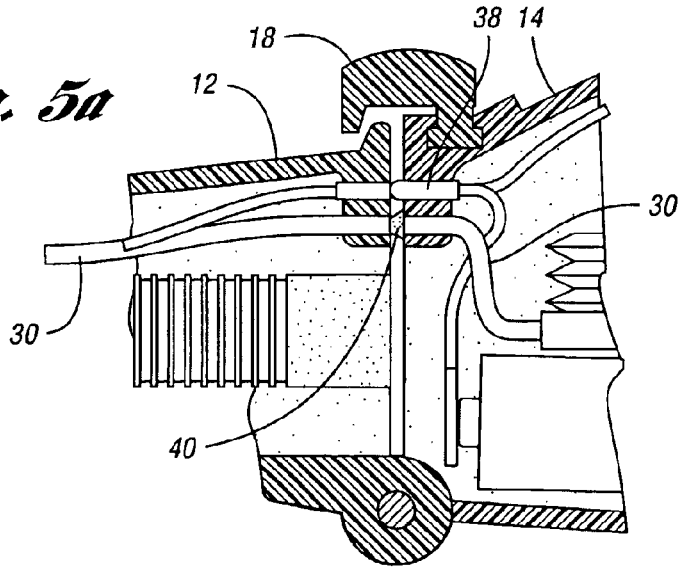

AIRBRUSH

BACKGROUND OF THE INVENTION

1. Field of the Invention

The present invention relates to an airbrush, more particularly to a unitary hand-held airbrush for dispensing liquid particles onto a workpiece.

2. Background Art

Airbrushes are typically limited to a small market of users due to the high costs of equipment, the amount of equipment required and the difficulties of use. These limitations generally limit the use of airbrushes to skilled artisans, seasoned hobbyists or the like, and discourage random users or temporal hobbyists whom are unwilling to dedicate the funds and work required to procure and efficiently use a conventional airbrush.

Conventional airbrushes require a fair amount of equipment in order to effectively use the airbrush. This equipment comprises the airbrush itself, a hand-held tool which operates as an atomizer compressing air to spray a liquid onto a surface or workpiece. The airbrush typically introduces the liquid such as paint into the compressed air such that the liquid becomes entrained in an air stream as liquid particles which exit the airbrush as a mist. The compressed air is provided by an air compressor, aerosol cans or any apparatus or mechanism for releasing compressed air.

Air compressors are typically expensive and heavy in weight. Thus, the cost of a compressor requires a user to dedicate a substantial amount of funds in order to begin using the airbrush. Aerosol cans are limited to the volume of each can and require a user to periodically change cans in order to continuously use the airbrush. Further, aerosol cans require that the user stock a plurality of cans in order to perform continuous use.

The airbrush itself is a high cost unit, typically having many parts manufactured to tight specifications and formed of expensive materials. These airbrushes typically comprise an elongate handheld body having a trigger, a valve operated air inlet and a liquid paint feed. The outlet nozzle of the airbrush typically includes an internal needle for regulating the outlet flow of the air stream. Many of these components are typically machined of stainless steel or aluminum requiring high costs in materials and manufacturing. The paint feed may be a liquid paint reservoir attached to the airbrush, or an aerosol paint mixture introduced into the airbrush as the source of compressed air. Airbrushes of this type are typically hard to clean, requiring a user to disassemble many components and clean with solvent and/or water before use of a different color or after completion of use. Accordingly, use of various colors is both tedious and costly to the end user. Moreover, the quantity of features provided by a conventional airbrush are relatively matched in the cost and complexity of the airbrush.

The prior art teaches use of the above-described airbrush in combination with a paint pen or marker having a nib introduced into the air stream, after the air stream exits the outlet nozzle of the airbrush. This approach eliminates some of the difficulties of using liquid paint feeds introduced into the air stream as described above.

The market recognizes a need for conventional airbrushes for painting nails either in beauty salons or for at-home use. Accordingly, manufacturers typically retail a conventional airbrush kit including a simplified conventional airbrush and aerosol cans for providing the compressed air supply. Such conventional airbrushes, rather than including an enlarged liquid reservoir, typically have a small liquid reservoir or merely a recess for holding a relatively small amount of liquid to be sprayed by the airbrush. Furthermore, the relatively small airbrush is generally easier to clean than larger liquid sources or reservoirs. These kits typically include a plurality of liquid paint sources contained within a plurality of paint bottles having needle drop-style spouts for dispensing a relatively minimal amount of paint into the airbrush.

The prior art also offers a low end, competitively priced alternative to the high end airbrushes described above. The target audience, of which this product is marketed, is typically children. These low end products typically include a plurality of markers or pens as liquid sources, rather than use of a liquid reservoir, aerosol paint supply or the like. Further, the airbrush is typically comprised of low cost plastic components providing little or no adjustability in the spray pattern or flow of the air stream.

The source of compressed air for these low end airbrushes is typically manual. The airbrush may include a mouthpiece for an inlet orifice such that a user may create an air stream of pressurized air by exhaling into the mouthpiece. This method limits the flow of the airbrush to the individual breaths of the user. This method further requires that the airbrush is held proximate to the line of sight of the user, thus limiting the view and operation of the airbrush. Other sources of compressed air include a manual air pump or elastomeric bulb mounted to the inlet of the airbrush allowing a user to manually provide compressed air. Although the prior art teaches a low cost solution for providing compressed air to an airbrush, the manually supplied compressed air results in non-continuous airflow, thereby providing an intermittent spray and poorly or uneven painted surfaces.

Low end airbrushes are also provided with a manual compressor or air pump defined as a separate or stand alone unit connected to the airbrush by a hose, tube or the like. Accordingly, this additional equipment leads to increased costs and reduced flexibility and maneuverability of the airbrush.

Various techniques and designs have provided airbrushes for dispensing liquid particles onto a surface or workpiece. Although the prior art has improved the cost and maneuverability of airbrushes, the quality and adjustability of spray is compromised in light of high end airbrush products. Accordingly, it is the goal of the present invention to provide a simplified, low cost, unitary, handheld airbrush incorporating the advantages of an adjustable high end airbrush.

SUMMARY OF THE INVENTION

The airbrush of the present invention includes an elongate body, a DC electric motor, an air pump, a switch and a removable pen. The elongate body has an internal cavity and an external grip surface to be held in the hand of a user. The DC electric motor and air pump are oriented within the body internal cavity and the motor operatively drives the air pump. The switch is oriented on the elongate body external surface proximate to a finger of a user's hand. The removable pen further includes an internal liquid reservoir and a nib. The pen cooperates with the elongate body and at least partially extends into a portion of the elongate body which defines an air chamber having an outlet nozzle and an inlet coupled to the air pump. The user selectively actuates the switch such that the motor drives the pump to provide an air stream of pressurized air to the air chamber which flows about the nib of the removable pen to draw liquid particles from the nib and into the air stream. The liquid particles, entrained in the air stream, form a mist which is sprayed from an outlet orifice of the outlet nozzle.

BRIEF DESCRIPTION OF THE DRAWINGS

FIG. 1 is a side elevational view of an exemplary embodiment airbrush;

FIG. 2 is a side elevational view of the airbrush of FIG. 1 illustrating the assembly of the airbrush with a removable pen;

FIG. 3 is an enlarged side elevational view of an alternative embodiment of a removable pen;

FIG. 4 is an enlarged partial section view of an outlet nozzle of the airbrush of FIG. 1;

FIG. 5 is a partial section view of the airbrush of FIG. 1;

FIG. 5*a* is an enlarged view of the partial section view of FIG. 5 illustrating an engagement between a forward portion and a rearward portion of the airbrush;

DETAILED DESCRIPTION OF THE PREFERRED EMBODIMENTS

Figure 6:
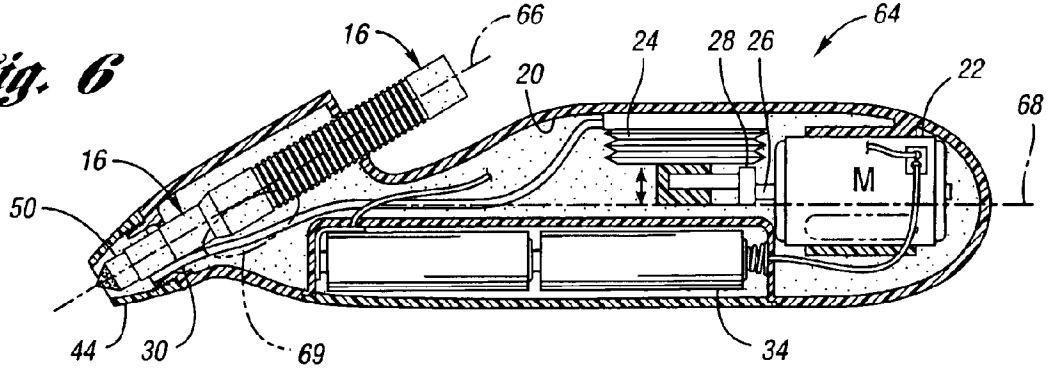
FIG. 6 is a partial section view of an alternative embodiment airbrush of the present invention.

FIG. 1 illustrates an exemplary embodiment airbrush referenced generally as numeral 10. The airbrush has a generally elongate body having an external grip surface to be held in the hand of a user. Unlike conventional airbrushes, airbrush 10 is a unitary airbrush ergonomically designed to comfortably fit within the grip of the hand of the user similar to gripping a large marker or the like. The elongate body of airbrush 10 is comprised of a forward portion 12 and rearward portion 14. The forward portion 12 and rearward portion 14 are separate body pieces cooperating together to retain a removable pen 16. As illustrated in FIGS. 1 and 2, the forward portion 12 and rearward portion 14 are pivotally connected together such that the forward portion 12 may be oriented relative to the rearward portion 14 in both a closed position in FIG. 1 and an open position in FIG. 2. The forward portion 12 is sized to receive the removable pen 16 therein such that the pen is retained within the elongate body in the closed position as illustrated in FIG. 1. In the open position, see FIG. 2, a user may easily remove the removable pen 16 from the forward portion 12 and interchange it with any of a plurality of removable pens 16. This feature allows a user to easily interchange colors, pen types or the like by merely advancing a latch 18 and opening the airbrush 10 by pivoting the forward portion 12 with respect to the rearward portion 14.

This pivotal connection may operate in a "break open" manner. This feature, as illustrated, allows the forward portion 12, to pivot with respect to the rearward portion 14 such that the user may readily interchange removable pens 16 and reconnect the elongate body while grasping the rearward portion 14.

The forward portion 12 and rearward portion 14 are each manufactured from a low cost, high strength material such as injection molded plastic. Preferably, each portion is formed of two separate half pieces which are oriented in a clamshell manner with respect to another and friction welded together. This manufacturing process effectively provides the elongate body having an external grip surface formed of the forward portion 12 and the rearward portion 14, and further including an internal cavity referenced generally as numeral 20 for the forward portion 12 and 20' for the rearward portion 14. The internal cavity 20,20' is illustrated in FIG. 5.

The airbrush further includes a DC electric motor 22 oriented within the internal cavity 20'. An air pump 24 is also oriented within the body internal cavity 20' and is operatively driven by the motor 22. The motor 22 is illustrated having an output shaft 26 rotationally driven by the motor 22 and provided with an eccentric drive 28 cooperating with the air pump 24. The air pump 24 is illustrated as a bellows pump having one end fixed with respect to the rearward portion 14, and a diaphragm which is movable in a reciprocating direction as illustrated by the double arrow in FIG. 5. Accordingly, the eccentric drive 28 drives the bellows pump 24 in a manner such that the diaphragm reciprocates for forcing the air from the bellows pump 24 through tubing 30 within the internal cavity 20, 20'. The rearward portion 14 includes an air intake port 32, as illustrated in FIG. 1, for permitting air to enter the rearward portion 14, and consequently the pump through an inlet (not shown) on the air pump 24.

The combination of the DC electric motor 22 and the air pump 24 provide a source of compressed air that is low cost in light of the components or equipment required, yet is sufficient to provide a continuous flow of air resulting in a steady air stream for dispensing liquid particles. Furthermore, the motor 22 and air pump 24 are relatively small in size and light in weight to efficiently and ergonomically orient within the airbrush 10 without adversely affecting the maneuverability of the airbrush 10 when in use.

A battery supply 34 is oriented within the internal cavity 20' for providing a source of power to the motor 22. The motor 22 is controlled by a switch 36 oriented on the elongate body external surface proximate to a finger of the user's hand. The switch 36 is illustrated as a push switch oriented within the internal cavity 20 of the forward portion 12, and extending externally therefrom. The switch 36 closes the electronic circuit between the battery supply 34 and DC electric motor 22 for controlling the operation of the airbrush 10. The invention contemplates that the switch 36 may include a locked position to prevent a user from accidentally dispensing a spray pattern when not desired.

When the airbrush 10 is in the open orientation as illustrated in FIG. 2, the electric leads between the switch 36 and the circuit defined by the battery supply 34 and motor 22 disconnect at electrical contact 38. See FIG. 5*a* for an enlarged view. Further, the tubing 30, which couples the air pump 24 to the forward portion 12 disconnects at rubber seal 40. Accordingly, the airbrush 10 is inoperable in the open position having both the compressed air supply disconnected and the electric circuit open regardless of the orientation of the switch 36.

Referring now to FIG. 4, the forward portion 12 of the elongate body further comprises an air chamber 42 having an outlet nozzle 44 and an inlet 46. The inlet 46 is provided by the tubing 30 supplying compressed air from the air pump 24 to the air chamber 42. The outlet nozzle 44 is illustrated as a separate portion cooperating with the forward portion 12. Accordingly, the air chamber 42 extends through the outlet nozzle 44.

The removable pen 16 comprises a liquid reservoir 48 and nib 50. The removable pen 16 cooperates with the forward portion 12 of the elongate body such that the removable pen 16 at least partially extends into the air chamber 42.

The user, grasping the elongate body of the airbrush 10, selectively actuates the switch 36 causing the motor 22 to drive the air pump 24, thus providing an air stream of pressurized air through the inlet 46 and into the air chamber 42. The air stream, illustrated as arrows located within the air chamber 42, flows about the nib 50 of the removable pen 16. The air stream consequently draws liquid particles from the nib 50 by the Bernoulli effect of the flow of air over the nib 50. As the air stream passes the nib 50, it forms a mist which is sprayed from an outlet orifice 52 of the outlet nozzle 44. The mist exiting the airbrush 10 is illustrated as arrows located downstream and externally of the air chamber 42.

The internal cavity 20 of the forward portion 12 and the air chamber 42 are separated by a rubber diaphragm 54. The diaphragm 54 forms a seal within the internal cavity 20 and the removable pen 16. The diaphragm 54 further includes an aperture through which the tubing 30 extends. Accordingly, the diaphragm 54 provides an air tight seal such that the only air that passes through the internal cavity 20 and the air chamber 42 is the compressed air through the tubing 30.

The outlet nozzle 44 is threadably engaged to the forward portion 12 such that the outlet nozzle 44 is adjustable relative to the elongate body. This feature permits a user to vary the proximity of the outlet orifice 52 to the nib 50 for adjusting the spray pattern. Similar to higher cost conventional airbrushes, the adjustable nozzle 44 provides a low cost solution for providing adjustability of the spray pattern. Further, if the airbrush needs to be cleaned after excessive use, or between pens 16 of varying color, the user may simply remove the nozzle 44 from the forward portion 12, clean the nozzle 44 with water, solvent or the like and reconnect the nozzle 44 to the forward portion 12.

The invention further contemplates that the outlet nozzle 44 is adjustable to a position such that the nib 50 extends out of the outlet orifice 52 as illustrated in FIGS. 4–6. This feature permits the user to contact the nib 50 against a surface or workpiece for writing directly thereon, similar to a conventional pen or marker.

The nib 50 of the removable pen is preferably porous for enhancing the flow of liquid particles drawn from the nib 50 and into the airstream. Further, the porous nib 50 enhances the capillary action of the liquid within the removable pen 16. The removable pen 16 may be provided with either ink or paint within the liquid reservoir 48. The paint may be acrylic, oil-based, water-based or the like. Further, for more specialized users, the removable pen 16 may be refillable such that a user may mix his or her own colors and fill the removable pen 16 with the desired color. Accordingly, the nib 50 may be removable from the removable pen 16 in order to clean the nib 50 or replace it with a fresh nib 50. Removable pen 16 may be provided with nibs 50 of varying lengths, diameters, or geometries for providing further variations of spray, adjustability or patterns.

For providing further adjustment of the spray pattern of the airbrush 10, the removable pen 16 is axially adjustable relative to the elongate body to vary the proximity of the nib 50 to the outlet orifice 52 for adjusting the spray pattern. The axial adjustment is provided by the engagement of the removable pen 16 within the rubber diaphragm 54. Accordingly, the diaphragm 54 is sized to receive the outer diameter of the removable pen 16 such that no air passes therethrough. Concurrently, the diaphragm 54 is resilient enough to allow the pen 16 to pass therethrough yet retains the pen 16 at a user selected position. This range of axial translation is prescribed by a forward region of the removable pen having a constant outside diameter.

In order for the user to adjust the axial position of the pen 16 without requiring the user to open the airbrush 10, the forward portion 12 of the elongate body does not fully enclose the pen 16, providing access to the removable pen 16. This access is illustrated in FIG. 1 as a U-shaped groove 56 formed through forward portion 12. The U-shaped groove 56 provides sufficient clearance such that the user may grip the external surface of the removable pen 16 and shift the pen forward or backward. As illustrated in FIGS. 4–6, the removable pen 16 is adjustable to a position such that the nib 50 extends out of the outlet orifice 52 permitting the nib 50 to contact a surface or workpiece.

Referring now to FIG. 3, a removable pen 58 is illustrated similar to the aforementioned removable pen 16, yet further comprising a series of configurations 60 formed externally about the body of the pen 58. The configurations 60 enhance frictional contact between the external surface of the pen 58 and the fingers of the user. The configurations 60 are illustrated as a series of annular rings formed about the body of the pen 58. This feature is illustrated on the removable pen 16 of FIGS. 4–6, however, is not necessary to operate the airbrush 10.

Referring now to FIG. 5, the airbrush 10 has a central axis 62 and the removable pen 16 is generally co-axially aligned with the central axis 62. Accordingly, the airbrush 10 is designed such that a user may operate the airbrush in the manner of a common pen, marker or the like. All the required components of the airbrush 10 are enclosed within the elongate body in an ergonomic hand-held design of which is low cost, has a low weight, under one and one-half pounds, and is sized to be held by the user. Further, the airbrush 10 provides adjustment features typical of high end conventional airbrushes.

Referring now to FIG. 6, an alternative embodiment airbrush 64 is illustrated having many of the same functions and features of the aforementioned embodiments. In comparison, however, the removable pen 16 of airbrush 64 has a pen axis 66 and the airbrush 64 has a central axis 68. The pen axis 66 is inclined relative to and generally intersecting with the elongate body central axis 68 of airbrush 64. The incline eliminates the requirement of having two separate pieces pivotally connected as illustrated in FIG. 5. Rather, prior to interchanging various removable pens 16, a user may simply remove the pen 16 and add another without having to open the elongate body of the airbrush 64. Further, the rearward portion of the removable pens 16 extends out of the elongate body of the airbrush 64 such that a user may adjust the axial position of the removable pen 16 by biasing this rearward portion.

The airbrush 64 of FIG. 6 has ergonomic advantages not realized in the airbrush 10 of FIG. 5. Particularly, the canted angle between the pen axis 66 and central axis 68 allows a majority of the airbrush 64 elongate body to rest on the back of the user's hand for improving maneuverability and preventing the user from experiencing a moment caused by the weight of the rearward portion 14 of the airbrush 10 on the user's grip at the forward portion 12 of the airbrush 10. Switch 69 is illustrated in phantom and oriented on the elongate body external surface and proximate to a finger of a user's hand.

Figure 7:
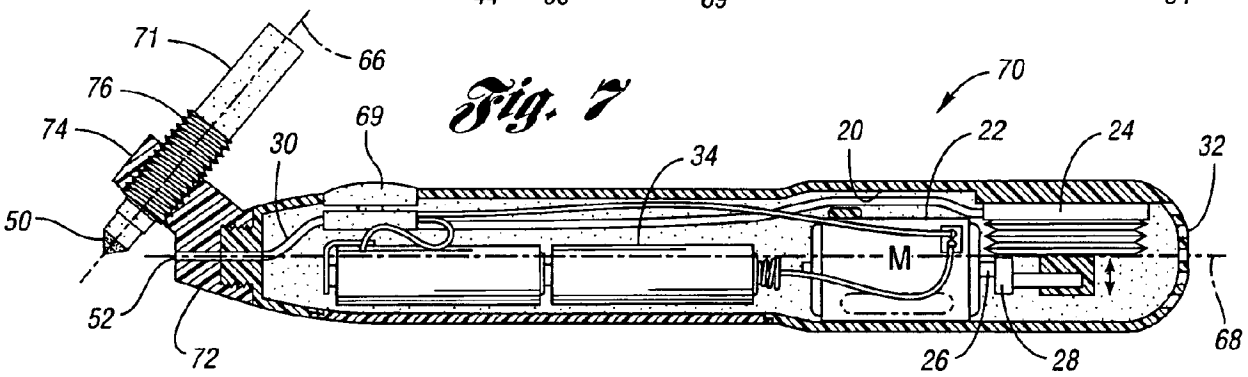
FIG. 7 is a partial sectional view of another alternative embodiment airbrush of the present invention.

Another alternative embodiment airbrush 70 is illustrated in FIG. 7, having many advantages similar to the prior embodiment. Similar elements retain same reference numerals, wherein new or different elements are assigned new reference numerals. Unlike the prior embodiments, the removable pen 71 of airbrush 70 is mounted externally with respect to the internal cavity 20 of the airbrush 70. The removable pen is oriented in such a manner that the nib 50 extends at least partially proximate to the outlet orifice 52. The airbrush 70 elongate body has a central axis 68 and the removable pen 71 is provided with a pen axis 66 which is inclined relative to, and generally intersecting with, elongate body central axis 68.

The airbrush 70 includes an outlet nozzle 72 mounted to a forward portion of the airbrush 70, and at least a portion of the internal air chamber 42 is defined in the outlet orifice 52. Further, the nozzle 72 includes a pen support bracket 74 extending therefrom. The pen support bracket 74 retains and orients the removable pen 71 such that the nib 50 is externally downstream from, and proximate to the outlet orifice 52. Therefore, the air stream exiting the outlet orifice 52 flows about the nib 50 and collects liquid particles, entrained into the air stream for generating a mist.

The removable pen 71 further includes a series of configurations 76 formed about an external surface. These configurations 76 are illustrated as threads such that the removable pen 71 is threadably engaged with the pen support bracket 74. Accordingly, a user may adjust the axial position of the removable pen 71 relative to the pen support bracket 74 by rotating the removable pen 71. This feature provides adjustment of the orientation of the removable pen 71 and, consequently, selective adjustment of the airbrush 70 spray pattern. Furthermore, a user may easily interchange pens 71 of varying color by merely unscrewing one pen 71 and replacing it with another.

The invention contemplates that the airbrush 70 may be used in combination with any liquid reservoir other than a removable pen. Accordingly, FIG. 7*a* illustrates an alternative outlet nozzle 78 having a relatively small paint cup 80 affixed thereon. The paint cup 80 is coupled to a liquid inlet within the air chamber such that compressed air passing therethrough collects liquid particles from the liquid inlet.

The paint cup 80 option allows a user to employ only a small amount of paint, as needed. The paint cup 80 is also relatively easy to clean. The user merely removes the outlet nozzle 78 from the airbrush 70 and cleans it with water, solvent, or the like. The outlet nozzle 78 may then be reattached to the airbrush 70 and compressed air may be driven therethrough to dry the outlet nozzle 78.

The paint cup 80 option is ideal for use when only a relatively small amount of paint is desired. Such applications include highlighting or shadowing a workpiece or surface. Other applications include painting a small workpiece such as fingernails or toenails.

Figure 7B:
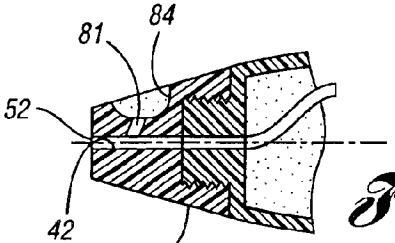
FIG. 7*b* is a section view of another alternative embodiment of a removable nozzle cooperable with the airbrush of FIG. 7.
Figure 7A:
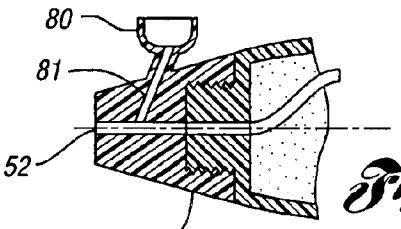
FIG. 7*a* is a side elevational view of an alternative embodiment of a removable nozzle cooperable with the airbrush of FIG. 7.

Referring now to FIG. 7*b*, another alternative embodiment outlet nozzle 82 is illustrated. Similar to the previous embodiment, the outlet nozzle 82 includes a recess 84 formed within an external surface of the outlet nozzle 82. The recess 84 defines a liquid reservoir coupled to the air chamber 42 by a liquid inlet 81. As the compressed air flows through the air chamber 42, it collects liquid particles from the liquid inlet 81 and forces the liquid particles out of the outlet orifice 52 of the outlet nozzle 82. This feature is similar in theory to the paint cup 80 option illustrated in FIG. 7*a*. The recess 84 can contain a relatively smaller volume of liquid, yet does not have an external paint cup 80 which may interfere with the grip or view of the user.

The embodiments illustrated and described in FIGS. 7, 7*a* and 7*b* provide an airbrush 70 that does not require a removable pen 16 partially extending within the airbrush 70. Accordingly, this feature leads to a much more streamlined airbrush 70. This design provides that the battery supply 34, motor 22, and air pump 24 are aligned generally coaxially such that the airbrush 70 has a smaller external grip surface in comparison to prior embodiments. Furthermore, the external grip surface is generally tapered, increasing in diameter from the outlet nozzle 72 to a rearward region of the airbrush 70. This ergonomic design also provides at least one air intake port 32 formed within a rearward portion of the airbrush 70 such that a user's hand will be less likely to interfere with the air flow to the air pump 24.

Figure 8:
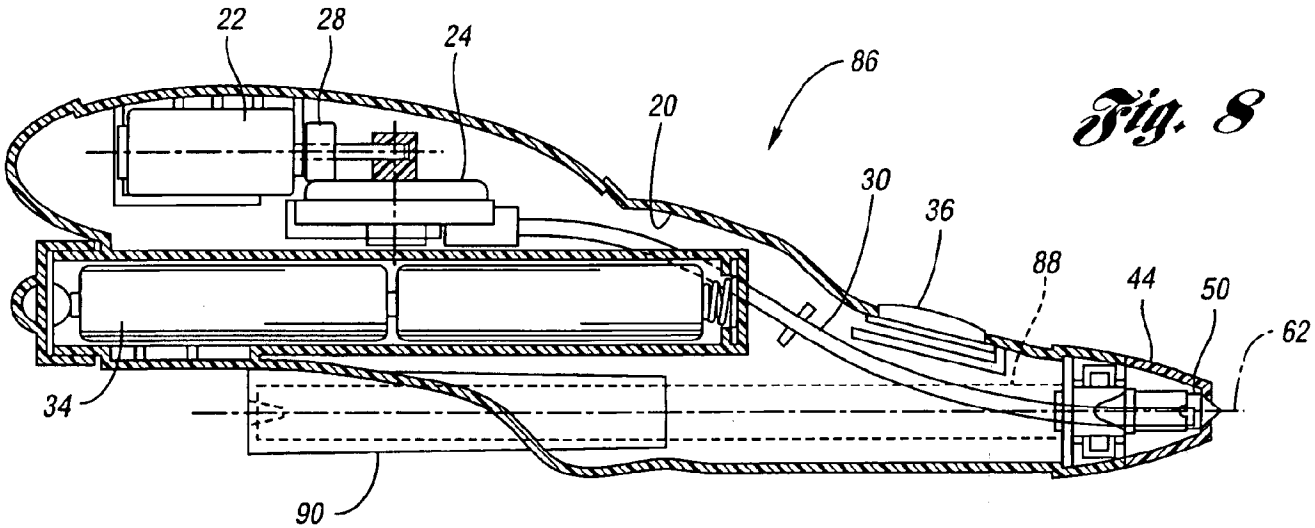
FIG. 8 is a partial section side view of a preferred embodiment airbrush.

Referring now to FIG. 8, a preferred embodiment airbrush 86 is illustrated. In this embodiment, many of the operating components of the airbrush 86 are offset from the central axis 62. For example, the battery supply 34 is oriented within the internal cavity 20 generally parallel to the central axis 62 and offset therefrom. The motor 22 and air pump 24 are oriented within the airbrush internal cavity 20 spaced apart from the central axis 62 and adjacent to the battery supply 34. The airbrush 86 is relatively ergonomic such that a majority of the mass of the airbrush 86 is located proximate to a back surface of the user's hand for resting thereon. Further, the switch 36 is oriented protruding from the housing in an external grip region for selective control by the user.

Due to the stacked orientation of the airbrush 86 components, a larger battery supply 34 is illustrated in comparison to prior embodiments. The larger battery supply 34 increases the time required between changing of batteries. The stacked design of the airbrush 86 also provides for a relatively larger elongate pen 88, also in comparison to the prior embodiments. The larger pen 88 includes a larger liquid reservoir such that the operational life of the individual pen 88 is increased for repetitive and continuous use.

The preferred embodiment airbrush 86 also permits a rearward end of the pen 88 to extend out of the housing, for providing access to the pen 88 such that the user may readily interchange pens 88. Unlike the "break open" airbrush embodiment pen, less components are required thus reducing the manufacturing and materials costs.

The airbrush 86 also includes a sleeve 90 connected to the housing and generally coaxial with the central axis 62. The sleeve 90 is sized to receive a portion of the pen 88 therein. The sleeve 90 is formed of a suitable material such that a desired amount of friction is provided against the external surface of the pen 88. The desired amount of friction may be sufficient to maintain the orientation of the pen 88 relative to the housing. However, this frictional engagement of the sleeve 90 and pen 88 is minimal such that a user may easily overcome the friction to axially translate the pen 88 for adjusting the spray pattern or interchanging pens 88. Accordingly, sleeve 90 may be formed of an elastomeric material.

Figure 9:
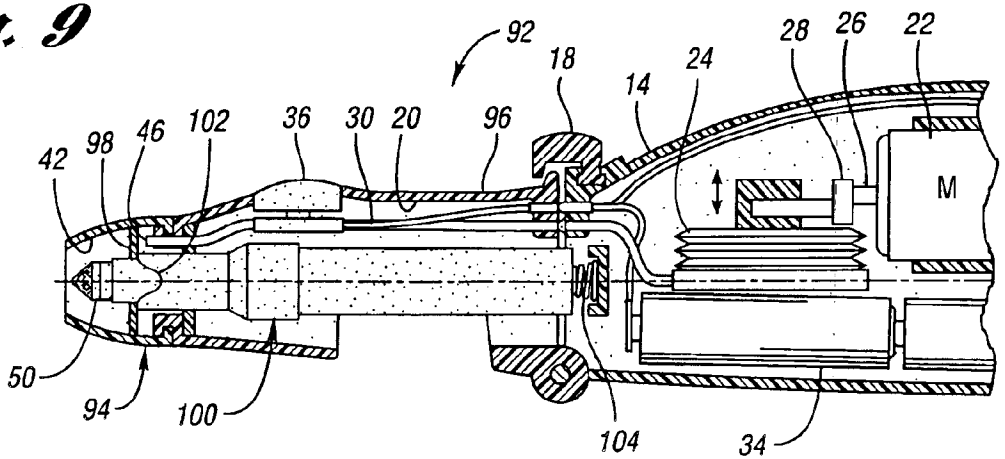
FIG. 9 is an enlarged partial section side view of an alternative embodiment airbrush.

With reference now to FIG. 9, an alternative embodiment airbrush 92 is illustrated in accordance with the present invention to allow the user to easily adjust the flow rate of liquid and the spray pattern. The airbrush 92 is similar to the "break open" airbrush 10 illustrated in FIG. 1. However, the airbrush 92 includes a nozzle 94 that is coupled for rotation relative to the forward portion 96 of the airbrush 92. The nozzle 94 includes a pair of inwardly extending followers 98 extending within the air chamber 42. An alternative embodiment pen 100 is illustrated oriented within the forward portion 96. The pen 100 has a nib 50 disposed within the air chamber 42 for providing a source of liquid particles into an air stream passing therethrough. The pen 100 is provided with a circumferential cam track 102 formed externally thereabout. The cam track 102 is sized to engage the followers 98 such that the nib 50 extends through the followers 98 and the engaged followers 98 and cam track 102 regulate the nib's axial orientation. As the user rotationally adjusts the radial orientation of the nozzle 94, the followers 98 progressively travel along the cam track 102 displacing the axial position of the pen 100. The airbrush 92 includes a compression spring 104 secured within the airbrush 92 and cooperating with the rearward end of the pen 100. Thus, in the closed position of the airbrush 92, the pen 100 is continuously biased forward such that the cam track 102 is continuously engaged with the followers 98. The pen 100 is prevented from rotating relative to the forward portion 96. Alternatively in this and in the FIG. 8 embodiment, the nozzle 94 can be fixed to the forward portion 96 and the pen 100 is rotated by the user to adjust the relative position of the nib 50 and nozzle 94.

When the followers 98 are oriented at the forward peaks of the cam track 102, as illustrated in FIG. 9, the followers 98 urge the pen 100 in a rearwardmost orientation wherein the compression spring undergoes its maximal displacement. As the nozzle 42 is further rotated, the engagement of the followers 98 with the decline of the cam track 102 permits the pen 100 to extend forward as biased from the compression spring 104. Of course, as the followers 98 are oriented within the rearward peaks of the cam track 102, the nib 50 is extended to a forwardmost orientation relative to the airbrush 92. Although the cam track 102 is illustrated on the pen 100, the invention contemplates that a cam track may be formed within the nozzle 94 and a corresponding pair of follower configurations may be formed to the pen 100 for engaging the cam track.

In summary, the present invention allows a user to experience the benefits, such as adjustability, quality of flow, portability and various color combinations, typically provided in a high end airbrush product, incorporated into a unitary low cost, ergonomically designed airbrush.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An airbrush comprising:

an elongate body having an internal cavity and an external grip surface to be held in the hand of a user;

a DC electric motor oriented within the body internal cavity;

an air pump oriented within the body internal cavity and operatively driven by the motor;

a switch oriented on the elongate body external surface proximate to a finger of a user's hand; and a removable pen having an internal liquid reservoir and a nib, the pen cooperating with the elongate body and at least partially extending into a portion of the elongate body which defines an internal air chamber having an outlet nozzle and an inlet coupled to the air pump;

wherein the user, grasping the elongate body, selectively actuates the switch to cause the motor to drive the pump providing an air stream of pressurized air to the air chamber which flows about the nib of the removable pen, drawing liquid particles from the nib into the air stream to form a mist which is sprayed from an outlet orifice of the outlet nozzle.

2. The airbrush of claim 1, wherein the nib is porous for enhancing the flow of liquid particles drawn from the nib and into the air stream.

3. The airbrush of claim 1, further comprising a battery supply oriented within the elongate body for providing a source of power to the motor.

4. The airbrush of claim 1, wherein the elongate body has a central axis and the removable pen is generally coaxially aligned with the central axis.

5. The airbrush of claim 1, wherein the elongate body comprises at least two separate body pieces cooperating together to retain the removable pen.

6. The airbrush of claim 1, wherein the air pump is further defined as a bellows pump.

7. The airbrush of claim 1, wherein the DC electric motor has an output shaft provided with an eccentric drive cooperating with the air pump.

8. The airbrush of claim 1, wherein the elongate body has a central axis and the removable pen is provided with a pen axis which is inclined relative to and generally intersecting with the elongate body central axis.

9. The airbrush of claim 1, wherein the liquid reservoir contains ink which saturates the nib and is drawn into the air stream as liquid ink particles.

10. The airbrush of claim 1, wherein the liquid reservoir contains paint which saturates the nib and is drawn into the air stream as liquid paint particles.

11. The airbrush of claim 1, wherein the total weight of the airbrush is less than one and one-half pounds.

12. An airbrush comprising:

an elongate body having an internal cavity and an external grip surface to be held in the hand of a user;

a DC electric motor oriented within the body internal cavity;

an air pump oriented within the body internal cavity and operatively driven by the motor;

a switch oriented on the elongate body external surface proximate to a finger of a user's hand;

a removable pen having an internal liquid reservoir and a nib the pen cooperating with the elongate body and at least partially extending into a portion of the elonate body which defines an internal air chamber having an outlet nozzle and an inlet coupled to the air pump; and an elongate sleeve oriented within the body and partially extending external to the body, the sleeve being adapted to receive the pen therein such that the pen extends, at least partially, into the internal air chamber;

wherein the user, grasping the elongate body selectively actuates the switch to cause the motor to drive the pump providing an air stream of pressurized air to the air chamber which flows about the nib of the removable pen drawing liquid particles from the nib into the air stream to form a mist which is sprayed from an outlet orifice of the outlet nozzle.

13. An airbrush comprising:

an elongate body having an internal cavity and an external grip surface to be held in the hand of a user;

a DC electric motor oriented within the body internal cavity;

an air pump oriented within the body internal cavity and operatively driven by the motor;

a switch oriented on the elongate body external surface proximate to a finger of a user's hand; and a removable pen having an internal liquid reservoir and a nib the pen cooperating with the elongate body and at least partially extending into a portion of the elongate body which defines an internal air chamber having an outlet nozzle and an inlet coupled to the air pump;

wherein the user, grasping the elongate body selectively actuates the switch to cause the motor to drive the pump providing an air stream of pressurized air to the air chamber which flows about the nib of the removable pen drawing liquid particles from the nib into the air stream to form a mist which is sprayed from an outlet orifice of the outlet nozzle; and wherein one of the pen and nozzle has a circumferential cam configuration, and the other of the pen and nozzle has a follower for engaging the circumferential cam configuration, such that rotation of the pen or nozzle axially adjusts the pen relative to the body to vary the proximity of the nib to the outlet orifice for adjusting the spray pattern.

14. An airbrush comprising:

an elongate body having an internal cavity and an external grip surface to be held in the hand of a user;

a DC electric motor oriented within the body internal cavity;

an air pump oriented within the body internal cavity and operatively driven by the motor;

a switch oriented on the elongate body external surface proximate to a finger of a user's hand; and a removable pen having an internal liquid reservoir and a nib the pen cooneratin with the elonaate body and at least partially extending into a portion of the elongate body which defines an internal air chamber having an outlet nozzle and an inlet coupled to the air pump;

wherein the user, grasping the elongate body, selectively actuates the switch to cause the motor to drive the pump providing an air stream of pressurized air to the air chamber which flows about the nib of the removable pen drawing liquid particles from the nib into the air stream to form a mist which is sprayed from an outlet orifice of the outlet nozzle and wherein the elongate body further comprises a forward portion, the forward portion including the air chamber internally, wherein the outlet nozzle is a separate portion cooperating with the forward portion such that the outlet nozzle is adjustable relative to the forward portion to vary the proximity of the outlet orifice to the nib for adjusting the spray pattern.

15. The airbrush of claim 14, wherein the outlet nozzle is adjustable to a position such that the nib extends out of the outlet orifice, permitting the nib to contact a surface or workpiece.

16. An airbrush comprising:

an elongate body having an internal cavity and an external grip surface to be held in the hand of a user;

a DC electric motor oriented within the body internal cavity;

an air pump oriented within the body internal cavity and operatively driven by the motor;

a switch oriented on the elongate body external surface proximate to a finger of a user's hand; and a removable pen having an internal liquid reservoir and a nib the pen cooperating with the elongate body and at least partially extending into a portion of the elongate body which defines an internal air chamber having an outlet nozzle and an inlet coupled to the air pump;

wherein the user, grasping the elongate body selectively actuates the switch to cause the motor to drive the pump providing an air stream of pressurized air to the air chamber which flows about the nib of the removable pen drawing liquid particles from the nib into the air stream to form a mist which is sprayed from an outlet orifice of the outlet nozzle and wherein the removable pen is axially adjustable relative to the elongate body to vary the proximity of the nib to the outlet orifice for adjusting the spray pattern.

17. The airbrush of claim 16, wherein the removable pen is adjustable to a position such that the nib extends out of the outlet orifice, permitting the nib to contact a surface or workpiece.

18. The airbrush of claim 16, wherein the removable pen includes a series of configurations for allowing a user to adjust the pen axially.

19. The airbrush of claim 16, wherein the elongate body does not fully enclose the removable pen, providing access to the removable pen sufficient for the user to grip an external surface of the removable pen.

20. A removable pen for use with an airbrush having an elongate body, a motor, an air pump operatively driven by the motor and coupled to an air nozzle for forcing air therethrough, the pen comprising;

a tubular body having an internal liquid reservoir; and a nib formed of porous material affixed to one end of the tubular body in fluid connection with the internal liquid reservoir;

wherein the pen is adapted to cooperate with an airbrush, such that the pen is axially adjustable relative to the airbrush when the pen nib extends at least partially into an air stream formed by the nozzle;

wherein an air stream of pressurized air provided by the airbrush flows through the air nozzle and about the nib, drawing liquid particles from the nib into the air stream to form a mist which is sprayed from the airbrush; and whereby a user may selectively translate the removable pen to vary the proximity of the nib to the outlet orifice for adjusting the spray pattern.

21. The removable pen of claim 20, wherein one of the pen and nozzle has a circumferential cam, and the other of the pen and nozzle has a follwer for engaging the circumferece cam configuration, such that rotation of the pen or nozzle axially adjusts the pen to the body to vary the proximity of the nib to the outlet orifice far adjusting the spray pattern.

22. An airbrush comprising:

an elongate body having an internal cavity and an external grip surface to be held in the hand of a user;

a DC electric motor oriented within the body internal cavity;

an air pump oriented within the body internal cavity and operatively driven by the motor for providing an air stream of pressurized air;

a switch oriented on the elongate body external surface proximate to a finger of a user's hand;

an air chamber having an outlet nozzle and an inlet coupled to the air pump for passing the air stream therethrough; and a removable pen having an internal liquid reservoir and a nib, the pen cooperating with the elongate body such that the nib is at least partially oriented proximate to an outlet orifice of the outlet nozzle;

wherein the user, grasping the elongate body, selectively actuates the switch to cause the motor to drive the pump providing the air stream of pressurized air which flows from the outlet orifice and about the nib of the removable pen, drawing liquid particles from the nib into the air stream to form a mist.

23. The airbrush of claim 22, wherein the nib is porous for enhancing the flow of liquid particles drawn from the nib and into the air stream.

24. The airbrush of claim 22, further comprising a battery supply oriented within the elongate body for providing a source of power to the motor.

25. The airbrush of claim 22, wherein the air pump is further defined as a bellows pump.

26. The airbrush of claim 22, wherein the DC electric motor has an output shaft provided with an eccentric drive cooperating with the air pump.

27. The airbrush of claim 22, wherein the elongate body has a central axis and the removable pen is provided with a pen axis which is inclined relative to and generally intersecting with the elongate body central axis the liquid reservoir contains.

28. The airbrush of claim 22, wherein the liquid reservoir contains ink which saturates the nib and is drawn into the air stream as liquid ink particles.

29. The airbrush of claim 22, wherein the liquid reservoir contains paint which saturates the nib and is drawn into the air stream as liquid paint particles.

30. The airbrush of claim 22, wherein the total weight of the airbrush is less than one and one-half pounds.

31. An airbrush comprising:

an elongate body having an internal cavity and an external grin surface to be held in the hand of a user;

a DC electric motor oriented within the body internal cavity;

an air pump oriented within the body internal cavity and operatively driven by the motor for providing an air stream of pressurized air;

a switch oriented on the elongate body external surface proximate to a finger of a user's hand;

an air chamber having an outlet nozzle and an inlet coupled to the air pump for passing the air stream therethrough; and a removable pen having an internal liquid reservoir and a nib the pen cooperating with the elongate body such that the nib is at least partially oriented proximate to an outlet orifice of the outlet nozzle;

wherein the user, grasping the elongate body selectively actuates the switch to cause the motor to drive the pump providing the air stream of pressurized air which flows from the outlet orifice and about the nib of the removable pen drawing liquid particles from the nib into the air stream to form a mist; and wherein the removable pen includes a series of configurations for allowing a user to adjust the pen axially.

32. An airbrush comprising:

an elongate body having an internal cavity and an external grip surface to be held in the hand of a user;

a DC electric motor oriented within the body internal cavity;

an air pump oriented within the body internal cavity and operatively driven by the motor for providing an air stream of pressurized air;

a switch oriented on the elonnate body external surface proximate to a finger of a user's hand;

an air chamber having an outlet nozzle and an inlet coupled to the air pump for passing the air stream therethrough;

a removable pen having an internal liquid reservoir and a nib the pen cooperating with the elongate body such that the nib is at least partially oriented proximate to an outlet orifice of the outlet nozzle; and an elongate sleeve oriented within the body and partially extending external to the body, the sleeve being adapted to receive the pen therein such that the pen extends, at least partially, into the internal air chamber;

wherein the user, grasping the elongate body selectively actuates the switch to cause the motor to drive the pump providing the air stream of pressurized air which flows from the outlet orifice and about the nib of the removable pen drawing liquid particles from the nib into the air stream to form a mist.

33. An airbrush comprising:

an elongate body having an internal cavity and an external grip surface to be held in the hand of a user;

a DC electric motor oriented within the body internal cavity;

an air pump oriented within the body internal cavity and operatively driven by the motor for providing an air stream of pressurized air;

a switch oriented on the elongate body external surface proximate to a finger of a user's hand;

an air chamber having an outlet nozzle and an inlet coupled to the air pump for passing the air stream therethrough; and a removable pen having an internal liquid reservoir and a nib the pen cooperating with the elongate body such that the nib is at least partially oriented proximate to an outlet orifice of the outlet nozzle;

wherein the user, grasping the elongate body selectively actuates the switch to cause the motor to drive the pump providing the air stream of pressurized air which flows from the outlet orifice and about the nib of the removable pen drawing liquid particles from the nib into the air stream to form a mist; and wherein one of the pen and nozzle has a circumferential cam configuration, and the other of the pen and nozzle has a follower for engaging the circumferential cam configuration, such that rotation of the pen or nozzle axially adjusts the pen relative to the body to vary the proximity of the nib to the outlet orifice for adjusting the spray pattern.

34. An airbrush comprising: an elongate, generally tubular body having an internal cavity and a tubular external grip surface to be held in the hand of a user; a DC electric motor oriented within the tubular body internal cavity; an air pump oriented within the tubular body internal cavity and operatively driven by the motor for providing an air stream of pressurized air; a switch oriented on the tubular body external surface proximate to a finger of a user's hand;

an air chamber having an outlet nozzle and an inlet coupled to the air pump for passing the air stream therethrough; and a removable pen having an internal liquid reservoir and a nib, the pen cooperating with the tubular body such that the nib is at least partially oriented proximate to an outlet orifice of the outlet nozzle;

wherein the user, grasping the tubular body, selectively actuates the switch to cause the motor to drive the pump providing the air stream of pressurized air which flows from the outlet orifice and about the nib of the removable pen, drawing liquid particles from the nib into the air stream to form a mist.

35. The airbrush of claim 34, wherein the pen nib at least partially extends into the air chamber.

36. The airbrush of claim 34, wherein the pen is oriented generally parallel to the tubular body.

37. The airbrush of claim 34, wherein the pen is oriented generally coaxial with the tubular body.

38. The airbrush of claim 34, wherein the pen is axially adjustable relative to the tubular body to regulate a flow pattern of the mist.

* * * * *

UNITED STATES PATENT AND TRADEMARK OFFICE

CERTIFICATE OF CORRECTION

PATENT NO. : 6,892,960 B2
DATED : May 17, 2005
INVENTOR(S) : Victor Alfred Ptak et al.

It is certified that error appears in the above-identified patent and that said Letters Patent is hereby corrected as shown below:

Column 11,
Line 37, delete “cooneration” and insert therefor -- cooperation --.
Line 37, delete “elonaate” and insert therefor -- elongate --.

Column 12,
Line 2, after “and” begin new paragraph with -- a removable --.
Line 14, after “nozzle” insert -- ; --.

Column 13,
Line 24, delete “the liquid reservoir contains”.
Line 36, delete “grin” and insert therefor -- grip --.

Column 14,
Line 51, after “comprising” begin a new paragraph with -- an elongate --.
Line 52, after “user” begin a new paragraph with -- a DC electric motor --.
Line 54, after “cavity” begin a new paragraph with -- an air pump --.
Line 57, after “pressurized air” begin a new paragraph with -- a switch --.

Signed and Sealed this

Twelfth Day of July, 2005

JON W. DUDAS
*Director of the United States Patent and Trademark Office*